US011999918B2

(12) United States Patent
Sarathy et al.

(10) Patent No.: US 11,999,918 B2
(45) Date of Patent: Jun. 4, 2024

(54) HYDROCARBON FUNCTIONALIZED CARBON-BASED NANOMATERIAL AND METHOD

(71) Applicants: KING ABDULLAH UNIVERSITY OF SCIENCE AND TECHNOLOGY, Thuwal (SA); SAUDI ARABIAN OIL COMPANY, Dhahran (SA)

(72) Inventors: Subram Mani Sarathy, Thuwal (SA); Tsu-fang Hong, Thuwal (SA); Andrew Bailey, Dhahran (SA); Anwar Alkhawajah, Dhahran (SA)

(73) Assignees: KING ABDULLAH UNIVERSITY OF SCIENCE AND TECHNOLOGY, Thuwal (SA); SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/913,611

(22) PCT Filed: Mar. 23, 2021

(86) PCT No.: PCT/IB2021/052405
§ 371 (c)(1),
(2) Date: Sep. 22, 2022

(87) PCT Pub. No.: WO2021/198848
PCT Pub. Date: Oct. 7, 2021

(65) Prior Publication Data

US 2023/0104932 A1 Apr. 6, 2023

Related U.S. Application Data

(60) Provisional application No. 63/002,859, filed on Mar. 31, 2020.

(51) Int. Cl.
*C10L 10/08* (2006.01)
*C10L 1/19* (2006.01)

(52) U.S. Cl.
CPC ..... *C10L 10/08* (2013.01); *C10L 1/19* (2013.01); *C10L 2200/0254* (2013.01);
(Continued)

(58) Field of Classification Search
CPC .... C10L 1/19; C10L 10/08; C10L 2200/0254; C10L 2200/04; C10L 2200/0446;
(Continued)

(56) References Cited

U.S. PATENT DOCUMENTS 5,779,742 A 7/1998 Baker
8,741,821 B2 6/2014 Jao et al.
(Continued)

FOREIGN PATENT DOCUMENTS

CN 101052456 A 10/2007
CN 104098816 A 10/2014
(Continued)

OTHER PUBLICATIONS

Choudhary et al: Dispersion of alkylated graphene in organic solvents and its potential for lubrication applications; Journal of Materials Chemistry, vol. 22, No. 39, Jan. 1, 2012 (Jan. 1, 2012) (Year: 2012).*
(Continued)

*Primary Examiner* — Ellen M McAvoy
*Assistant Examiner* — Chantel Graham
(74) *Attorney, Agent, or Firm* — PATENT PORTFOLIO BUILDERS PLLC

(57) ABSTRACT

A fuel mixture includes a fuel, ethanol, and modified graphene oxide (mGO) nanoparticles functionalized with a hydrocarbon. The mGO is less than 1000 ppm of the ethanol, and a blend of the ethanol and the mGO is less than 10% of the fuel mixture.

20 Claims, 14 Drawing Sheets

(52) U.S. Cl.
CPC ... *C10L 2200/04* (2013.01); *C10L 2200/0446* (2013.01); *C10L 2230/22* (2013.01); *C10L 2270/026* (2013.01); *C10L 2290/24* (2013.01)

(58) Field of Classification Search
CPC ..... C10L 2230/22; C10L 2270/026; C10L 2290/24; C10L 1/23; C10L 1/24
See application file for complete search history.

(56) References Cited

U.S. PATENT DOCUMENTS

| | | | | |
|---|---|---|---|---|
| 10,017,706 | B1 * | 7/2018 | Loebick | C10L 1/16 |
| 2009/0000186 | A1 | 1/2009 | Sanders et al. | |

FOREIGN PATENT DOCUMENTS

| | | | |
|---|---|---|---|
| CN | 108658066 | A | 10/2018 |
| ES | 2236255 | | 7/2005 |
| JP | 2005508442 | A | 3/2005 |
| WO | 0200812 | A2 | 1/2002 |
| WO | 03040270 | A2 | 5/2003 |
| WO | 2018224902 | A1 | 12/2018 |

OTHER PUBLICATIONS

First Substantive Examination Report in corresponding/related Saudi Arabian Application No. 522440755, dated Aug. 7, 2023.
Berman, D., et al., "Graphene: A New Emerging Lubricant," Materials Today, Jan./Feb. 2014, vol. 17, No. 1, pp. 31-42, Elsevier Ltd.
Chen, H., et al., "Study on Combustion Characteristics and PM Emission of Diesel Engines Using Ester-Ethanol-Diesel Blended Fuels," Proceedings of the Combustion Institute, Jan. 2007, vol. 31, Issue 2, pp. 2981-2989, Elsevier Inc.
Choi, S.U.S., et al., "Enhancing Thermal Conductivity of Fluids with Nanoparticles," ASME, Oct. 1995, p. 99-106.
Choudhary, S., et al., "Dispersion of Alkylated Graphene in Organic Solvents and its Potential for Lubrication Applications," Journal of Materials Chemistry, Aug. 17, 2012, vol. 22, Issue 39, pp. 21032-21039, the Royal Society of Chemistry.
El-Seesy, A.I., et al., "Investigation of the Effect of Adding Graphene Oxide, Graphene Nanoplatelet, and Multiwalled Carbon Nanotube Additives with n-Butanol-Jatropha Methyl Ester on a Diesel Engine Performance," Renewable Energy, Aug. 7, 2018, vol. 132, pp. 558-574, Elsevier Ltd.
Ghamari, M., et al., "Combustion Characteristics of Colloidal Droplets of Jet Fuel and Carbon Based Nanoparticles," Fuel, Oct. 12, 2016, vol. 188, pp. 182-189, Elsevier Ltd.
Gupta, B., et al., "Energy Efficient Reduced Graphene Oxide Ddditives: Mechanism of Effective Lubrication and Antiwear Properties," Scientific Reports, Jan. 4, 2016, 6:18372, 10 pages.
Hulwan, D.B., et al., "Performance, Emission and Combustion Characteristic of a Multicylinder DI Diesel Engine Running on Diesel-Ethanol-Biodiesel Blends of High Ethanol Content," Applied Energy, Jul. 28, 2011, vol. 88, pp. 5042-5055, Elsevier Ltd.
International Search Report in corresponding/related International Application No. PCT/IB2021/052405, dated Jun. 22, 2021.
Rakopoulos, D.C., et al., "Influence of Properties of Various Common Bio-Fuels on the Combustion and Emission Characteristics of High-Speed DI (Direct Injection) Diesel Engine: Vegetable Oil, Bio-Diesel, Ethanol, n-Butanol, Diethyl Ether," Energy, Jun. 28, 2014, vol. 73, pp. 354-366, Elsevier Ltd.
Soudagar, M.E.M., et al., "The Effects of Graphene Oxide Nanoparticle Additive Stably Dispersed in Dairy Scum Oil Biodiesel-Diesel Fuel Blend on CI Engine: Performance, Emission and Combustion Characteristics," Fuel, Aug. 31, 2019, vol. 257, 116015, 17 pages, Elsevier Ltd.
Written Opinion of the International Searching Authority in corresponding/related International Application No. PCT/IB2021/052405, dated Jun. 22, 2021.
Zhai, W., et al., "Carbon Nanomaterials in Tribology," Carbon, Apr. 21, 2017, vol. 119, pp. 150-171, Elsevier Ltd.
Communication Pursuant to Article 94(3) EPC in corresponding/related European Application No. 21714964.0, dated Jul. 19, 2023.
First Office Action in corresponding/related Chinese Application No. 202180026200.2, dated Feb. 3, 2024.

* cited by examiner

ASTM D6079.

| Conditions | Baseline | Low Load | High Load | ASTM D6079 |
|---|---|---|---|---|
| Ball diameter (mm) | 10 | 10 | 10 | **6** |
| Load (N) | 5 | 5 | 6 | **2** |
| Temperature (°C) | 25 | 60 | 60 | **60** |
| Stroke (mm) | 1 | 1 | 1 | **1** |
| Frequency (Hz) | 50 | 50 | 50 | **50** |
| Initial contact pressure (MPa) | 802 | 802 | 852 | **837** |
| Hardness ball | | 58-62 HRC | | **58-66 HRC** |
| Hardness disk | | 61-63 HRC (ca. 740 HV30) | | **190-210 HV30** |

FIG. 2B

HYDROCARBON FUNCTIONALIZED CARBON-BASED NANOMATERIAL AND METHOD

CROSS-REFERENCE TO RELATED APPLICATIONS

This application is a U.S. National Stage Application of International Application No. PCT/162021/052405, filed on Mar. 23, 2021, which claims priority to U.S. Provisional Patent Application No. 63/002,859, filed on Mar. 31, 2020, entitled "FUELS CONTAINING FUNCTIONALIZED CARBON-BASED NANOFLUIDS AND PREPARATION METHOD THEREOF," the disclosures of which are incorporated herein by reference in their entirety.

BACKGROUND

Technical Field

Embodiments of the subject matter disclosed herein generally relate to a functionalized carbon-based nanomaterial, and more particularly to such a material that can be well dispersed in fuels for enhancing fuel performance in internal combustion engine applications.

Discussion of the Background

To meet regulations on SOx and NOx emissions, current diesel fuels are required to remove sulfur-, oxygen-, nitrogen-, and aromatic-derived compounds. However, the removal of such compounds results in the loss of lubricity, especially for the low-sulfur diesel (LSD). LSD is considered to have a sulfur content of less than 10 mg/kg. Successful fuel delivery relies on such compounds to form a protective tribofilm that can separate contacting metallic surfaces and reduce asperity-contact induced force and wear in the boundary lubrication regime. As LSD is used in high-pressure-and-high-frequency fuel delivery systems (e.g., common rail injectors), metal surfaces can be gradually abraded without a tribofilm protection, and eventually lead to severe problems such as fuel pump breakdown, fuel injection failure, abnormal combustion behavior, etc.

To improve the lubricity of the LSD, the addition of biofuels containing oxygenated compounds has been commonly applied, such as furans, alcohols, fatty acids or fatty acid methyl esters (FAMEs, also known as biodiesel). For FAMEs, increasing the aliphatic chain and unsaturation degree helps LSD to regain its fuel lubricity. The presence of free fatty acids in biodiesel also improves diesel fuel lubricity due to enhanced interactions with metallic surfaces.

However, the addition of certain short-chain hydrocarbons could have a negative effect on fuel lubricity. For instance, blending ethanol in LSD raised concerns about the loss of fuel lubricity. Some researchers argued that little or inconclusive fuel lubricity loss can be found by blending ethanol to diesel fuel up to 14% (v/v), but the diesel fuel used in the study already consisted of 6.7% FAMEs, which was able to initiate the formation of a tribofilm to provide certain fuel lubricity prior to the ethanol addition.

The potential loss of the LSD's lubricity due to the adding of the ethanol is associated with the disappearance of the protective tribofilm that separates the metallic surfaces of the engine that uses the fuel, under high-frequency reciprocation conditions. Carbon-based nanomaterials are known for their superior friction and wear reduction due to their slippery crystalline structures, strong intramolecular bonding, large surface to volume ratios, good Young's modulus, and high load-bearing capacities [1-3]. Since nanofluids were first introduced to improve the thermal conductivity of the host fluid [4], the advantages of adding carbon-based nanomaterials have been intensively studied for applications in diesel, biofuels and jet fuels [5-10]. Blending carbon-based nanomaterials with biofuels, such as methyl esters, butanol, ethanol, etc., could reduce emissions, improve brake thermal efficiency, and save fuel consumption in compression ignition engines [5-9].

In this regard, U.S. Pat. No. 5,779,742 [11] discloses a fuel formulation that includes acylated nitrogen compounds which are useful as low chlorine containing additives for lubricating oils and liquid fuels. Spain patent application ES2236255T3 [12] discloses a method for improving the efficiency of the combustion processes and/or reduce harmful emissions. The solution proposed in this patent relates to a liquid fuel additive suitable for dispersing a Lanthanide oxide (rare earth) with alkyl carboxylic anhydrides in a fuel. Japanese Patent Application JP2005508442A [13] discloses a method for improving combustion efficiency and reducing harmful emissions. The approach relates to fuel containing rare earth metals, transition metals or the periodic table IIA, IIIB, doped cerium oxide with a divalent or trivalent metal or metalloid, which is a VB or VIB metal. U.S. Patent Application Publication no. 2009/0000186 [14] discloses nano-sized metal particles and nano-sized metal oxide particles that can be used to improve combustion, decrease harmful exhaust emissions, and increase catalytic chemical oxidation of fuel. U.S. Pat. No. 8,741,821 B2 [15] describes methods for friction modification and wear reduction using fully formulated lubricants containing nanoparticles. In particular, oil-soluble nanospherical components are used in lubricant formulations to reduce friction coefficients thereof and as wear reducing agents therefor. International Patent Application no. WO 2018/224902 [16] discloses a method for synthesizing a nano-emulsion fuel composition. The method may include forming a water-in-fossil fuel emulsion by dispersing water into a fossil fuel in the presence of a surfactant and synthesized carbon quantum dots with an average diameter between 0.5 nanometers to 20 nanometers. However, none of these methods or materials do achieve a good dispersion of the nanomaterials in fuel, with the simultaneous fuel performance enhancement.

Thus, there is a need for a new product that is capable of improving the lubricity of the LSD fuel, while also achieving a good and stable dispersion in the fuel.

BRIEF SUMMARY OF THE INVENTION

According to an embodiment, there is a fuel mixture that includes a fuel, ethanol, and modified graphene oxide (mGO) nanoparticles functionalized with a hydrocarbon. The mGO is less than 1000 ppm of the ethanol, and a blend of the ethanol and the mGO is less than 10% of the fuel mixture.

According to another embodiment, there is a method of making a fuel mixture and the method includes mixing graphene oxide with dodecanol to obtain modified graphene oxide, mGO, nanoparticles via esterification, wherein the mGO is functionalized with a hydrocarbon, mixing the mGO nanoparticles with ethanol so that the mGO nanoparticles are less than 1000 ppm of the ethanol, and blending the mGO nanoparticles with the ethanol with a fuel to obtain the fuel mixture. The ethanol and the mGO nanoparticles are less than 10% of the fuel mixture.

According to still another embodiment, there is a method of making a fuel mixture and the method includes mixing a single-layer graphene oxide with a reacting agent to obtain modified graphene oxide, mGO, nanoparticles via esterification, wherein the mGO is functionalized with a hydrocarbon, mixing the mGO nanoparticles with ethanol so that the mGO nanoparticles are less than 1000 ppm of the ethanol, and blending the mGO nanoparticles with the ethanol with a fuel to obtain the fuel mixture. The ethanol and the mGO nanoparticles are less than 10% of the fuel mixture, and the reacting agent is X-(O)R1, where X is one of H, OH, S, or N, and R1 is a linear or branched hydrocarbyl group.

BRIEF DESCRIPTION OF THE DRAWINGS

For a more complete understanding of the present invention, reference is now made to the following descriptions taken in conjunction with the accompanying drawings, in which:

FIG. 2B presents reference and measured values of the modified graphene oxide nanoparticles with the testing system of FIG. 2A;

DETAILED DESCRIPTION OF THE INVENTION

Figure 1:
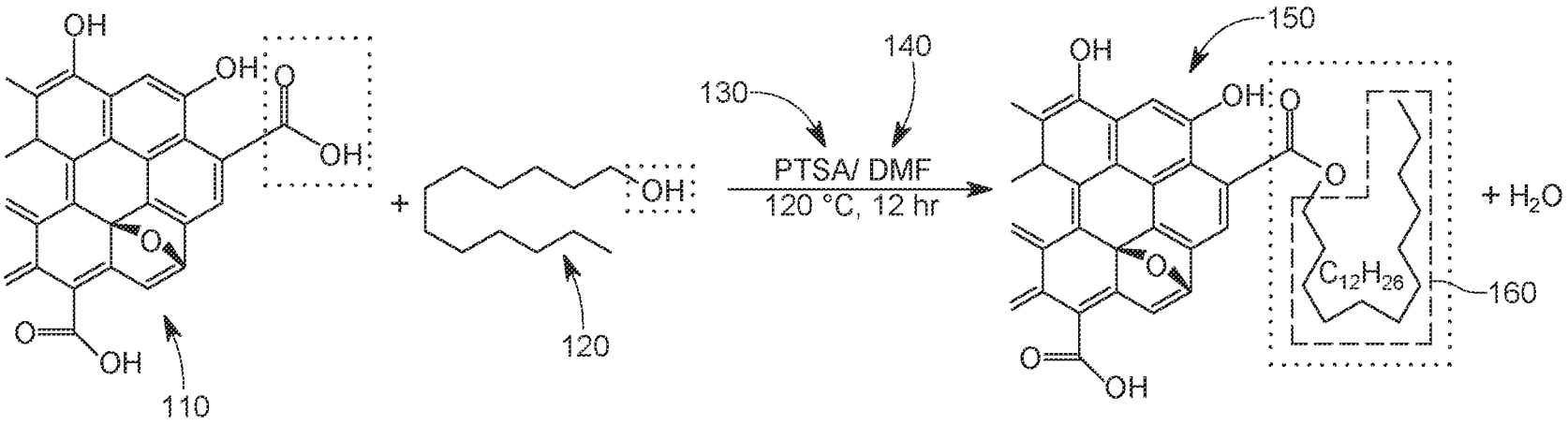
FIG. 1 is a schematic diagram of an esterification process for generating hydrocarbon functionalized modified graphene oxide nanoparticles.

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a low sulfur diesel and modified graphene oxide nanoparticles. However, the embodiments to be discussed next are not limited to the low sulfur diesel or to the modified graphene oxide, but may be applied to other fuels and/or other carbon-based nanoparticles.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, carbon-based nanomaterials functionalized with hydrocarbon are added to the LSD for enhancing fuel lubricity. In this embodiment, the carbon-based nanomaterials are added to the LSD fuel while being mixed with ethanol. The surface modified graphene oxide (mGO) has been chosen in this embodiment as a targeted carbon-based nanomaterial for fuel lubricity testing. The surface of the mGO was modified in this embodiment with dodecanal via esterification to improve the dispersion stability in ethanol (EtOH-$C_2H_5OH$) as a nanofluid. EtOH and mGO/EtOH were blended with LSD and the associated fuel lubricity performances and the underlying mechanisms were investigated as now discussed.

According to an embodiment, the functionalized carbon based nanoparticles have a size ranging from 1 nm to 1000 nm. Examples of carbon based nanomaterials/nanoparticles can be graphene, graphene oxide, fullerene, and carbon nanotubes. The carbon based nanomaterials without functionalization cannot be well dispersed in fuels. In this embodiment, the carbon based nanomaterial is selected to be graphene oxide. However, any of the carbon based nanomaterial noted above may be used in the following embodiments. The graphene oxide is functionalized by a synthesis procedure for improving the dispersion stability in various types of fuel. For example, the carbon based nanofluid can be prepared by blending synthesized carbon-based nanomaterials with different fuel blends, such as low-sulfur diesel, biodiesel, and gasoline. The fuel specified in this disclosure is not limited to biofuels, synthetic fuels, or fossil fuels, but can be any fuel with a broad range of hydrocarbons that can be applied for internal combustion (IC) engines. The functionalization on the carbon based nanomaterial disclosed in this application is not limited to improve the dispersion stability in fuel, but can have other possible advantages that can enhance fuel properties, combustion performances, and emission reductions from internal combustion engines.

In one embodiment, as illustrated in FIG. 1, a single-layer graphene oxide GO 110, unmodified, is reacted with dodecanol 120 ($C_{12}H_{26}O$), via esterification catalyzed by p-toluene sulfonic acid (PTSA) 130, using solvent dimethylformamide (DMF) 140 to obtain the hydrocarbons functionalized carbon-based nanomaterial 150, which is also referred to mGO herein. Note that the GO 110 is single-layer in this embodiment, i.e., the GO layer includes only a single layer. In one application, 100 mg of single-layer GO (unmodified) 110 can be mixed with 4.26 g of dodecanol 120 in DMF 140 and catalyzed using 50 mg (0.29 mmol) p-toluene sulfonic acid monohydrate 130 in an oil bath at 120° C. for 12 to 24 hours. After the reaction, the solution was washed by methanol and acetone to remove the unreacted dodecanol. The washed mGO nanoplatelets 150 were dried at 50 to 60° C. in the vacuum oven for 12 hours to 3 days. Depending on the application for which the mGO is intended, the reacting agent 120 (surface modifying agent) can have a formula with the following functionalities:

X—(O)R1, wherein X may be —H, —OH, —S—, or —N, typically X may be —OH and —H; R1 may be a linear or branched hydrocarbyl group containing 1 to 40, 3 to 30, 4 to 30, 5 to 30, 6 to 30, 8 to 24, 8 to 20, 8 to 18, 5 to 10, or 10 to 18 carbon atoms; typically, R1 may be a linear or branched group alkyl, aryl, alkaryl, alkoxy, aryloxy, which have lipophilic characteristics. Note that the reacting agent in this embodiment has been selected to be the dodecanol and after the reaction of the GO with the dodecanol, the mGO is functionalized with the hydrocarbon 160, which includes 12 atoms of C and 24 or 26 atoms of H. However, any of the reacting agents described by X—(O)R1 may be used for enhancing the dispersion stability of GO in different types of fuels.

The obtained mGO and the non-modified GO were then individually added to corresponding amounts of the EtOH to form supernatants with a similar weight concentration of, for example, 50 ppm. In this application, 50 ppm of mGO relative to the EtOH means 50 mg of mGO per 1 I of EtOH. For example, the mGO nanoplatelets obtained as discussed above were dispersed in 25 ml EtOH using sonication for 2 h, followed by one or more cycles of centrifugation to remove the unreacted GO. Similarly, the unmodified GO was added to EtOH to form the other supernatant. The two supernatants were then tested as now discussed.

The chemical functionality of the prepared mGO and unchanged GO were characterized by Fourier transform infrared spectroscopy (FTIR). Thermal gravimetric analysis on GO and mGO was performed under 20 sccm nitrogen purge with a heating rate of 10° C./min in a Simultaneous Thermal Analyzer. The viscosities of ethanol, ethanol derived nanofluid, and other blends were measured by a viscometer with a 2 mm aluminum ball spinning at 1000 rpm from 25° C. to 60° C. The dispersion stability of the prepared mGO/EtOH supernatant was evaluated by the spectrum of UV-vis spectroscopy with different suspension times from 1 day (24 hours) up to 30 days, depending on the degree of surface modification on mGO.

The mechanism of diesel fuel lubricity is commonly attributed to forming of a protective tribofilm that separates metallic surfaces under high-frequency reciprocation conditions. According to this mechanism, the total horizontal force ∫dF is assumed to follow the derivative of the average flow model from Reynold's equations, as illustrated in equation (1):

$$\int dF = \int V_r(\phi_{fp}h - h_T)\frac{\partial p}{\partial x}dx + \int \frac{2\mu U}{h} V_r \phi_{fs} dx, \tag{1}$$

where $V_r$ is the surface roughness factor, h is the nominal flow thickness, $h_T$ is the average film separation thickness, p is the local pressure, x is the sliding distance, μ is the viscosity, U is the sliding velocity, and $\phi_{fp}$ and $\phi_{fs}$ are the corresponded shear stress factors with local pressure and sliding speed, respectively. In equation (1), the first term represents the asperity-contact induced force due to the local normal pressure acting on the contact surface. The second term represents the shear-induced force which is associated with the kinematic viscosity of the bulk fluid. The total stress σ represents the total horizontal force acting on the specific surface area A, as described in equation (2):

$$\sigma = \frac{\int dF}{A}. \tag{2}$$

Given the total stress, the rate constant for wear on the contacting surface can be expressed by the stress-assisted tribochemical reaction rate given by equation (3):

$$\gamma = A\exp\left\{\frac{-(\Delta E_{act} + \sigma V_{act}}{k_b T}\right\}, \tag{3}$$

where y is the stress-assisted rate constant, A is the effective frequency factor, $\Delta E_{act}$ is the activation energy, $\Delta V_{act}$ is the activation volume, $k_b$ is the Boltzmann constant, and T is the temperature. Increasing the total horizontal force accelerates the wear rate on the contacting surface, resulting in the loss of lubricity. As a consequence, an effective formulation for enhancing fuel lubricity could be designed by minimizing either the shear-stress induced force or the asperity-contact induced force.

Fuel lubricity can be evaluated in a high-frequency reciprocating test system as per American Society for Testing and Materials (ASTM) D6079 by measuring the wear scar diameters of a tested stainless ball in a ball-on-disk reciprocation. However, the measured wear scar diameters of tested balls are sometimes too small to discriminate the fuel lubricity performance. Knothe et al. (Knothe G., Evaluation of ball and disc wear scar data in the HFRR lubricity test. Lubr Sci 2008; 20:35-45. doi:10.1002/Is.51.) showed a strong positive correlation between the wear scar diameter of the tested ball and the surface characteristics of wear tracks on a flat disk. To mitigate bias of fuel lubricity performance from only measuring ball wear scar diameters, various surface characteristics of a flat disk wear track, including wear track length, width, depth, average roughness (Ra), and root mean square (RMS), were adopted for evaluation.

Figure 2A:
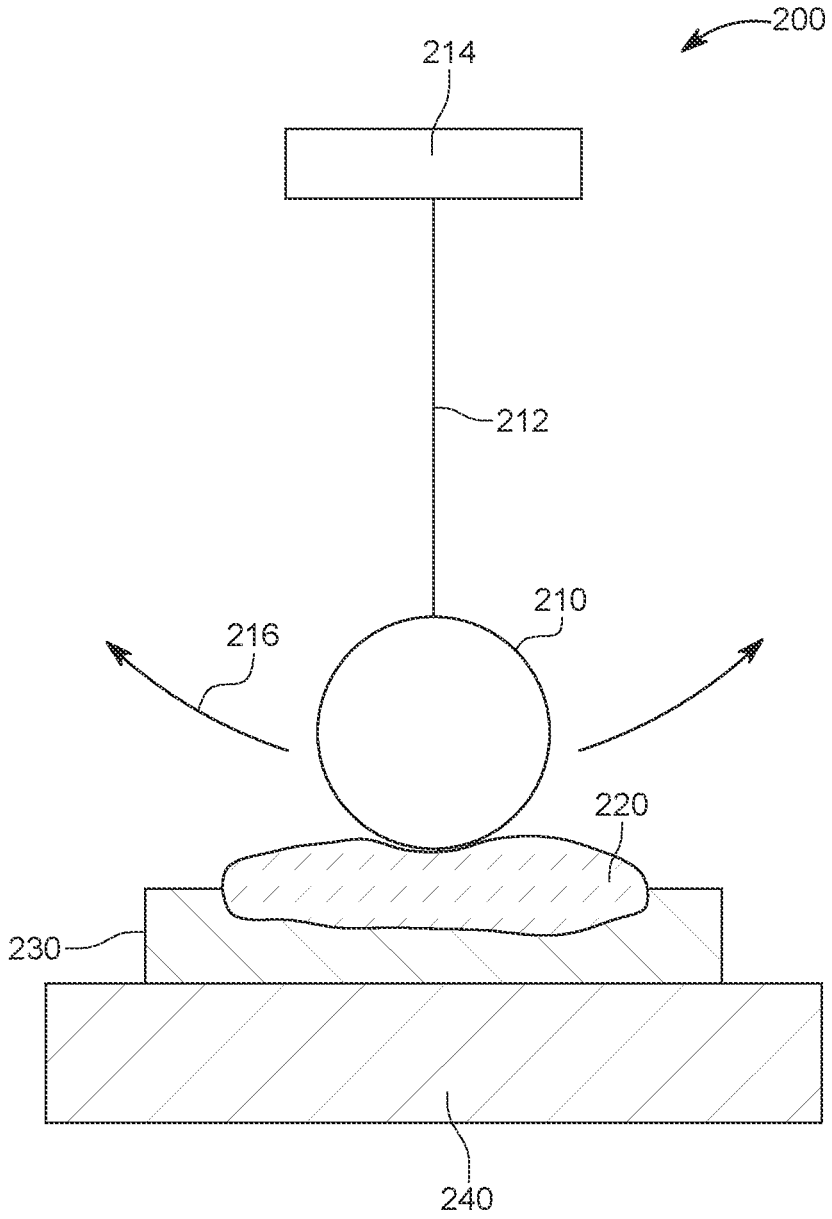
FIG. 2A illustrates a testing system used for determining various properties of the modified graphene oxide nanoparticles.

In a first experiment, a test system 200 as shown in FIG. 2A was used to evaluate the fuel lubricity by using a similar method and configuration as specified in ASTM D6079. The test system 200 has a stainless-steel ball 210 which is immersed in a fuel blend 220 and strokes against a stainless-steel flat disk 230 for 75 minutes at a constant frequency. A rod 212 connects the ball 210 to a driver 214, which drives the ball along the disk 230 with the constant frequency. The flat disk 230 is placed on a heater 240, that is used to simulate various temperatures. The movement of the ball 210 over the disk 230, which is indicated by arrows 216 in the figure, creates indentations or ridges or scars into the disk 230, and by measuring these scars, it is possible to determine various properties of the fuel blend 220 that is present between the ball 210 and the disk 230. The composition and properties of the fuel blend 220 influence the shape and size of the ridges. The parameters considered for different operating conditions for the testing system 200 are summarized in the table in FIG. 2B. To investigate the effect of contact pressure, tests were performed under the loads of 5N and 6N with estimated initial Hertzian contact pressure 802 MPa and 852 MPa, respectively, to explore fuel lubricity performance below and above the contact pressure specified in ASTM D6079. The calculation of the initial contact pressure is based on DIN 51834-1, as shown in equation (4):

$$P_{inital} = 0.388 \times \sqrt[3]{\frac{F_n \times E^2}{r^2}}. \quad (4)$$

Evaluation of the fuel lubricity and coefficient of friction (COF) from the room temperature to 60° C. was conducted to investigate the effect of the ethanol evaporation. Note that the coefficient of friction COF can be defined as noted in equation (5):

$$COF = \frac{\int df}{F_n}, \quad (5)$$

where F, is the normal force action on the contact surface between the ball 210 and the disk 230, which is kept constant in all the experiments herein. The increase in the average COF means the rise in the total horizontal force ∫df. The concentration of the modified graphene oxide was also varied to study the contribution of the mGO on the LSD fuel lubricity. Uniformly dispersed mGO/EtOH (50 ppm) solutions were prepared at different weight percent of 1%, 3%, and 5%, respectively, by blending with LSD under water-bath sonication for 3 minutes. While the experiment was performed with 50 ppm mGO to the EtOH solution, similar results are obtained with a range of 40 to 1000 ppm mGO to EtOH solution. The weight percentages noted above refer to the amount in kg of the mGO/EtOH relative to the amount in kg of the amount of the LSD fuel. In other words, a 1% mGO/EtOH solution in LSD means that for 99 kg of LSD, there is 1 kg of mGO/EtOH.

For the surface analysis of the worn disk 230, the mixture of 5 wt % pure EtOH with LSD was chosen as the reference for other blends containing mGO. A surface analysis was conducted after the worn disk 230 was rinsed by hexane and ethanol with sonication and dried to ensure no remaining contaminants. Note that the worn disks used for surface analysis were all from the baseline experimental conditions. The derived chemical profiles, morphologies, and elemental mapping from tribochemical reactions on the wear track were obtained by multiple surface analysis tools. Surface chemical profiles on the wear tracks were analyzed using Raman Spectroscopy with Cobalt-source visible light at 473 nm (1800 grating, 25% filter, and 300 μm confocal hole) after the calibration of the Raman shift at 520.65 $cm^{-1}$. A bright-light microscope was used to focus on different characteristic areas within the wear track before collecting the spectrum. The Raman spectrum was then acquired from 200 $cm^{-1}$ to 3000 $cm^{-1}$. An Optical Profilometer was utilized to characterize the flat wear track, including depth, width, length, surface roughness average (Ra) and root mean square (RMS), to analyze differences in fuel lubricity performance. The surface morphology on the wear tracks was examined using a scanning electron microscope.

Figure 3A:
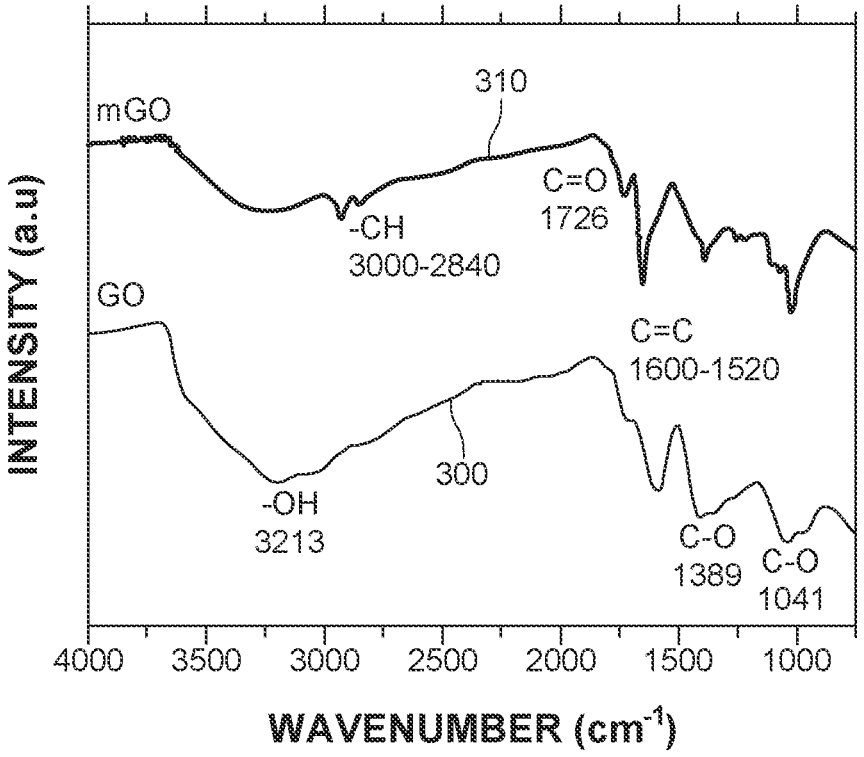
FIG. 3A shows the Fourier transform infrared spectroscopy spectra and FIG. 3B shows the UV-vis spectra of the graphene oxide and modified graphene oxide.
Figure 3B:
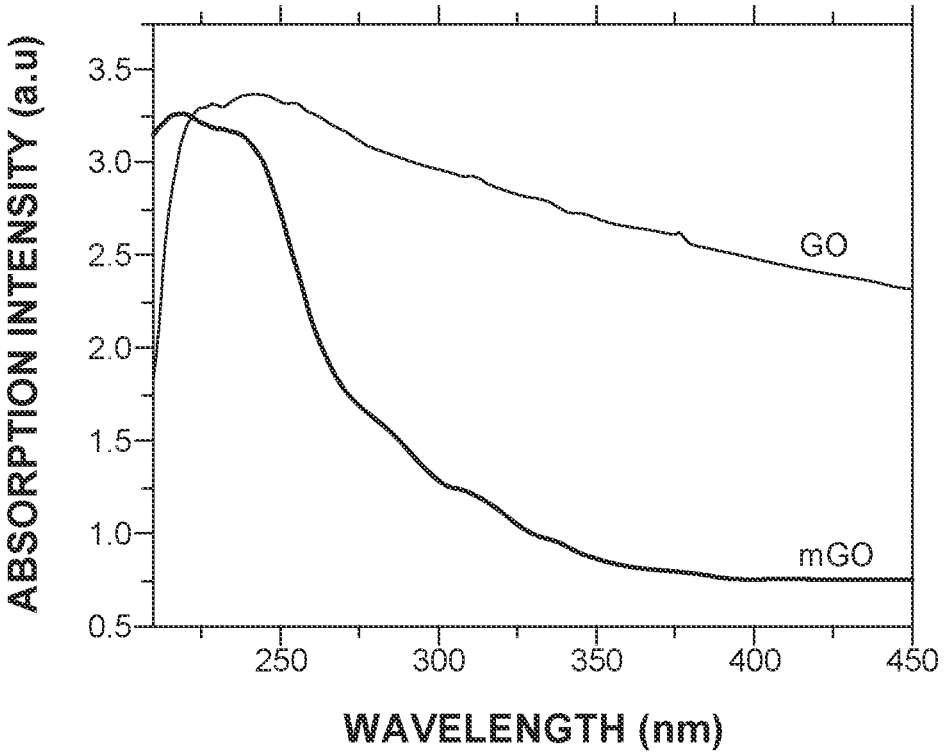
Figure 4A:
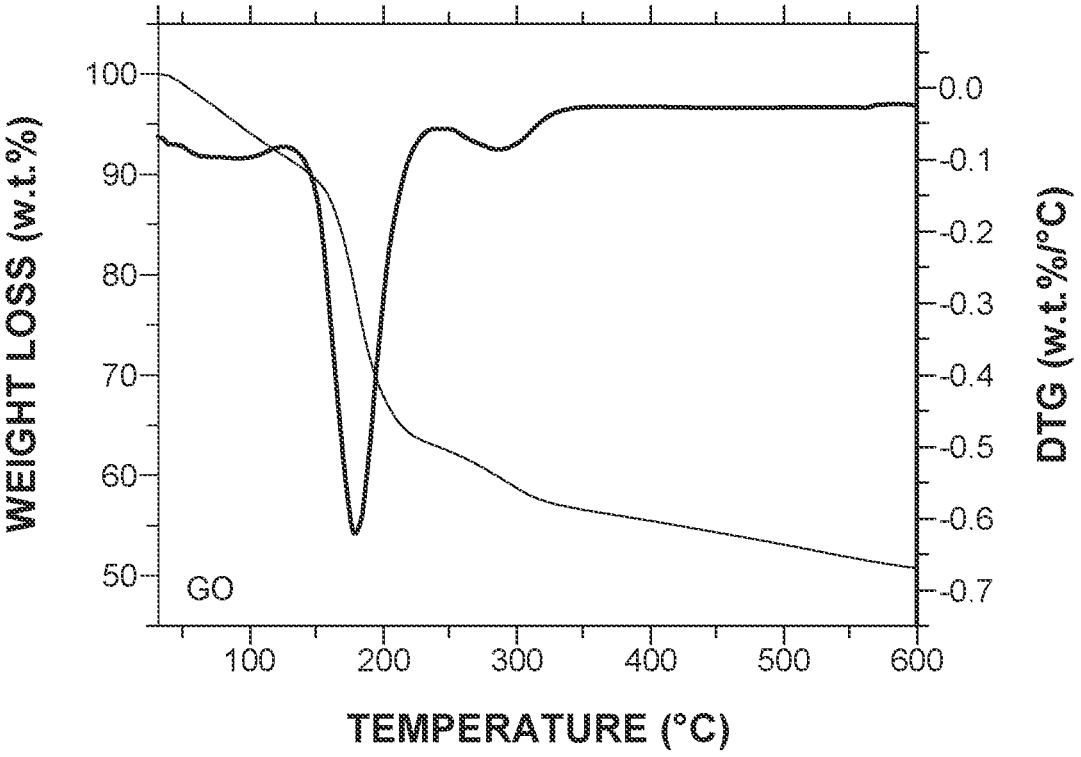
FIG. 4A shows the thermogravimetry curves and FIG. 4B shows the differential thermogravimetry curves of the graphene oxide and modified graphene oxide.
Figure 4B:
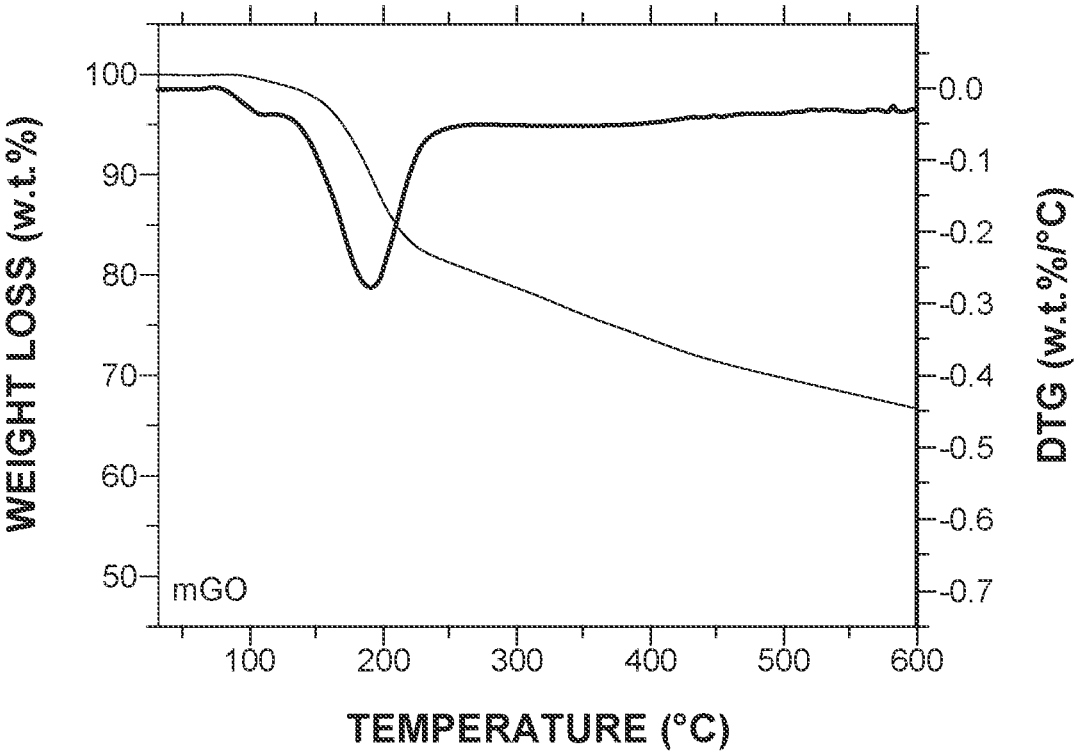

FIG. 3A shows the FTIR spectrum 300 of the graphene oxide and its characteristic signals of hydroxyl (3213 $cm^{-1}$), carbonyl (1389 and 1041 $cm^{-1}$), the aromatic (between 1600 and 1520 $cm^{-1}$) functional groups. After the esterification process using dodecanol, the spectrum 310 of the modified graphene oxide shows a clear elimination of the OH signal and the additional peaks from 2840 to 3000 $cm^{-1}$ corresponding to the C—H functional groups. FIG. 3B, which plots the absorption intensity versus the wavelength, shows that the mGO in EtOH dispersion eliminated the UV light adsorption from about 250 nm to 450 nm compared with the GO, which can be assigned to the hydroxyl groups from esterification on the GO surface or edges. The successful modification of the GO material is further confirmed by thermal gravimetric analysis of the GO and mGO materials shown in FIGS. 4A and 4B, respectively. The slight weight loss below 100° C. for GO can be attributed to the vaporization of the trapped water by multiple oxygenated functionalities, such as hydroxyl, carbonyl, and epoxy groups, even though samples were vacuum dried at 60° C. for three days. From the analysis of the differential thermogravimetry (DTG) curves, the major weight loss for GO occurs at approximately 175° C. while the weight loss of mGO happens at around 190° C. The delay in thermal degradation temperature for mGO is further evidence of successful surface modification wherein oxygenated functionalities were partially replaced by dodecanol.

Figure 5:
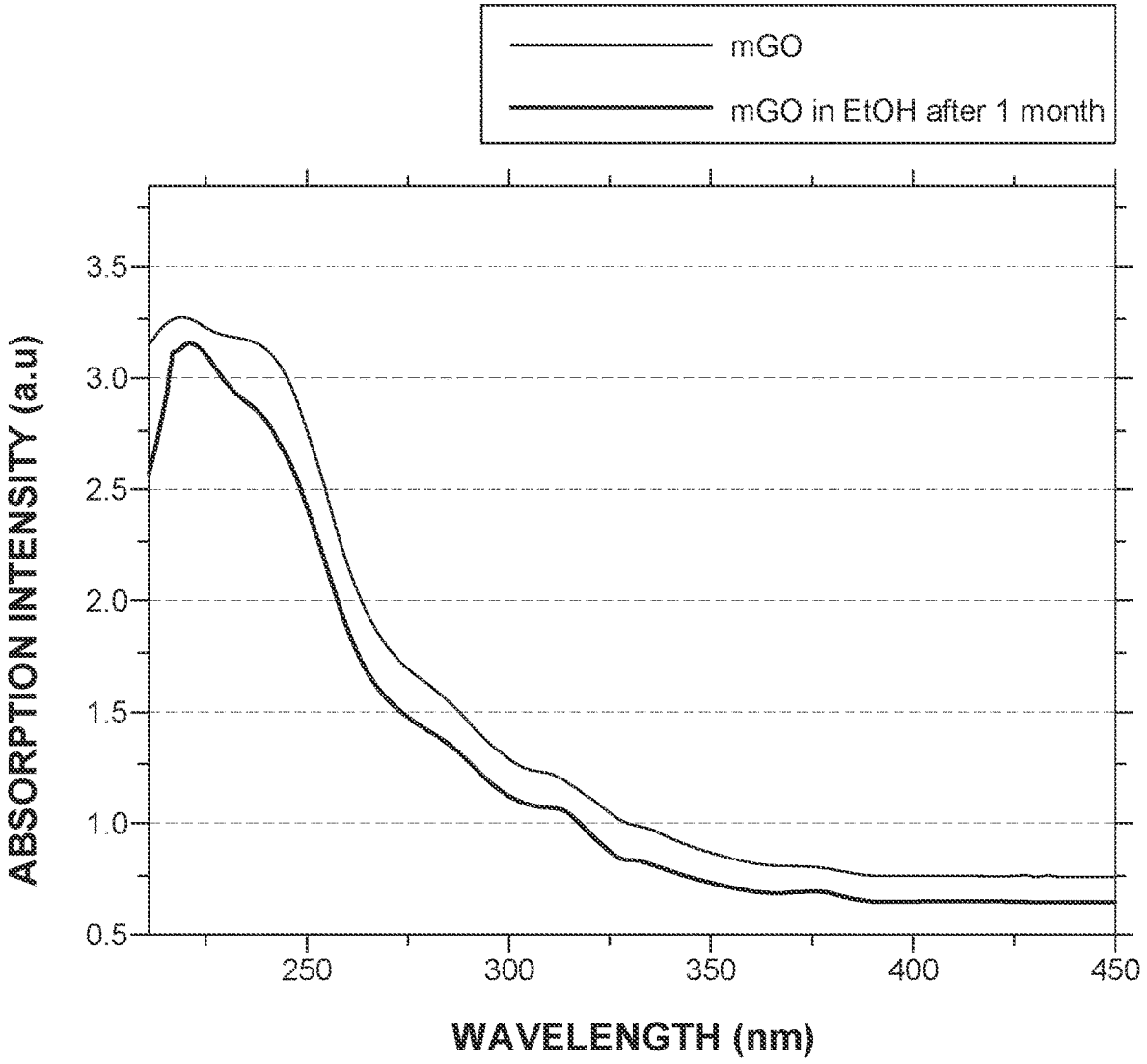
FIG. 5 shows the Fourier transform infrared spectroscopy spectra of the modified graphene oxide after one day and after one month.

To evaluate the particle dispersion stability, the GO and mGO were each added to ethanol to form supernatants with a weight concentration of 50 ppm. The inventors have found that the GO/EtOH supernatant aggregated and settled rapidly within one week while the mGO/EtOH supernatant was well-dispersed for over one month, which demonstrates the better dispersion stability of the later. The difference in the dispersion stability can be explained by comparing the nanostructures of the GO and the mGO. After the evaporation of the ethanol, the GO agglomerated together while the mGO was stretched and spread along a flat surface. The different behavior between the GO and mGO could be attributed to the different ways of minimizing surface free energy during ethanol evaporation. The interactions among the hydroxyl groups of the GO can lead to the agglomeration, where the interactions among the alkyl groups in the surface modified mGO prevent aggregation. Additionally, only a minor reduction in the adsorption intensity was found by comparing the UV-vis spectrum of the mGO/EtOH supernatant after sitting one day and one month, which are illustrated in FIG. 5, which further confirms the excellent dispersion stability of the mGO in EtOH.

Figure 6:
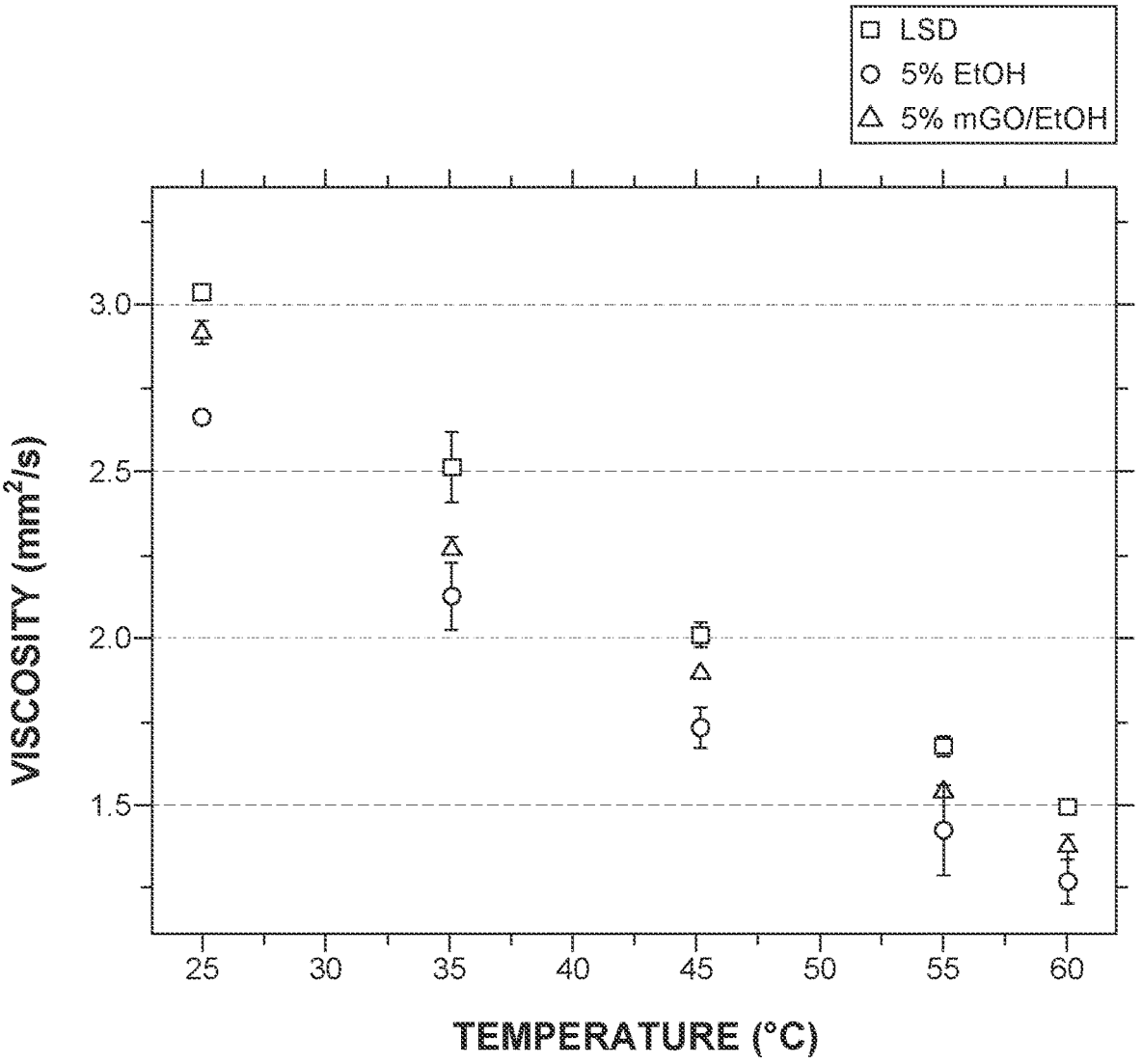
FIG. 6 shows the viscosity of the low sulfur diesel, the low sulfur diesel mixed with ethanol, and the low sulfur diesel mixed with ethanol and modified graphene oxide nanoparticles.

In terms of the bulk fluid viscosities, the presence of the mGO in ethanol altered the original behavior of the ethanol in the LSD. The viscosity of the LSD was reduced by blending it with 5% EtOH or with 5% mGO/EtOH (50 ppm), as illustrated in FIG. 6. However, the viscosity of the mixture that includes the 5% EtOH was slightly lower than the viscosity of the mixture that includes 5% mGO/EtOH to LSD. This would suggest a potential reduction in the shear-induced force, but an increase in the asperity-contact induced force. The actual effects of formulating EtOH with LSD on the fuel lubricity is discussed later.

Figure 7:
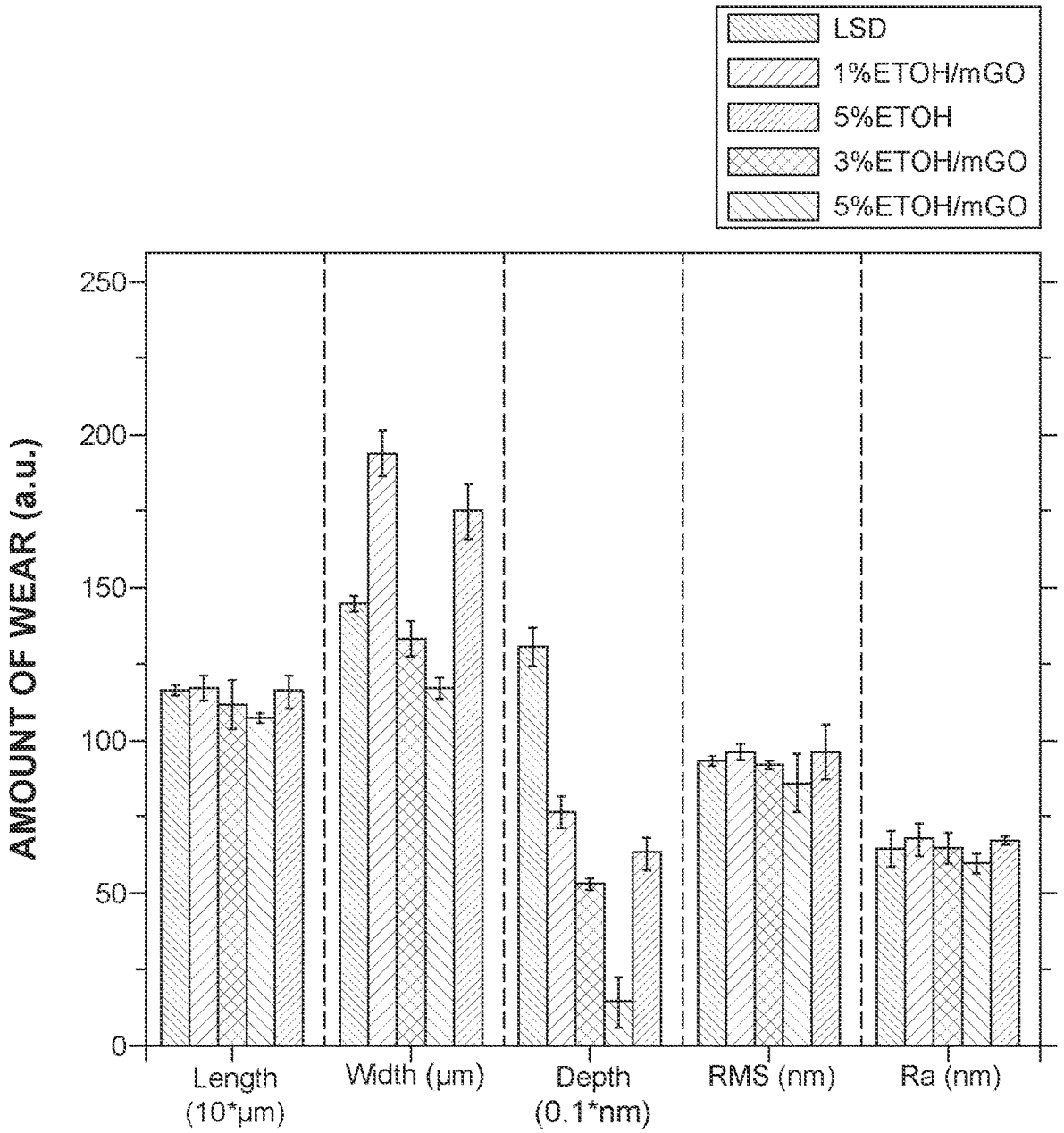
FIG. 7 shows the concentration effect of the various mixtures added to the low sulfur diesel.

The fuel lubricity performance of the various mixtures introduced above is now discussed. FIG. 7 compares the fuel lubricity performance of nanofluids at different concentrations to the performance of pure ethanol blends in LSD and also pure LSD. The amount of wear in the disk 230 in the testing system 200 is plotted on the Y axis while the length, width, depth and associated measures of the ridge formed in the disk 230 are shown on the X axis. By increasing the mGO/EtOH blending concentration from 1% to 5% shows a trend of decreasing the average coefficient of friction, as well as a reduction in the surface characteristics measured from the worn disk, including wear track length, width, average depth, RMS, and Ra. Reductions in wear track length, width, depth, RMS and Ra mean improved fuel lubricity, which is provided by the blended mGO. By comparing the measured surface parameters between the 5% mGO/EtOH and 5% EtOH in FIG. 7, the presence of the mGO improved the fuel lubricity when blended with EtOH.

Because the average COF is positively correlated to the measured surface characteristics, reducing the average COF enhances fuel lubricity due to the reduction in the total horizontal force, total stress, and wear rates, as previously discussed above with regard to equations (1) to (3).

Figure 8:
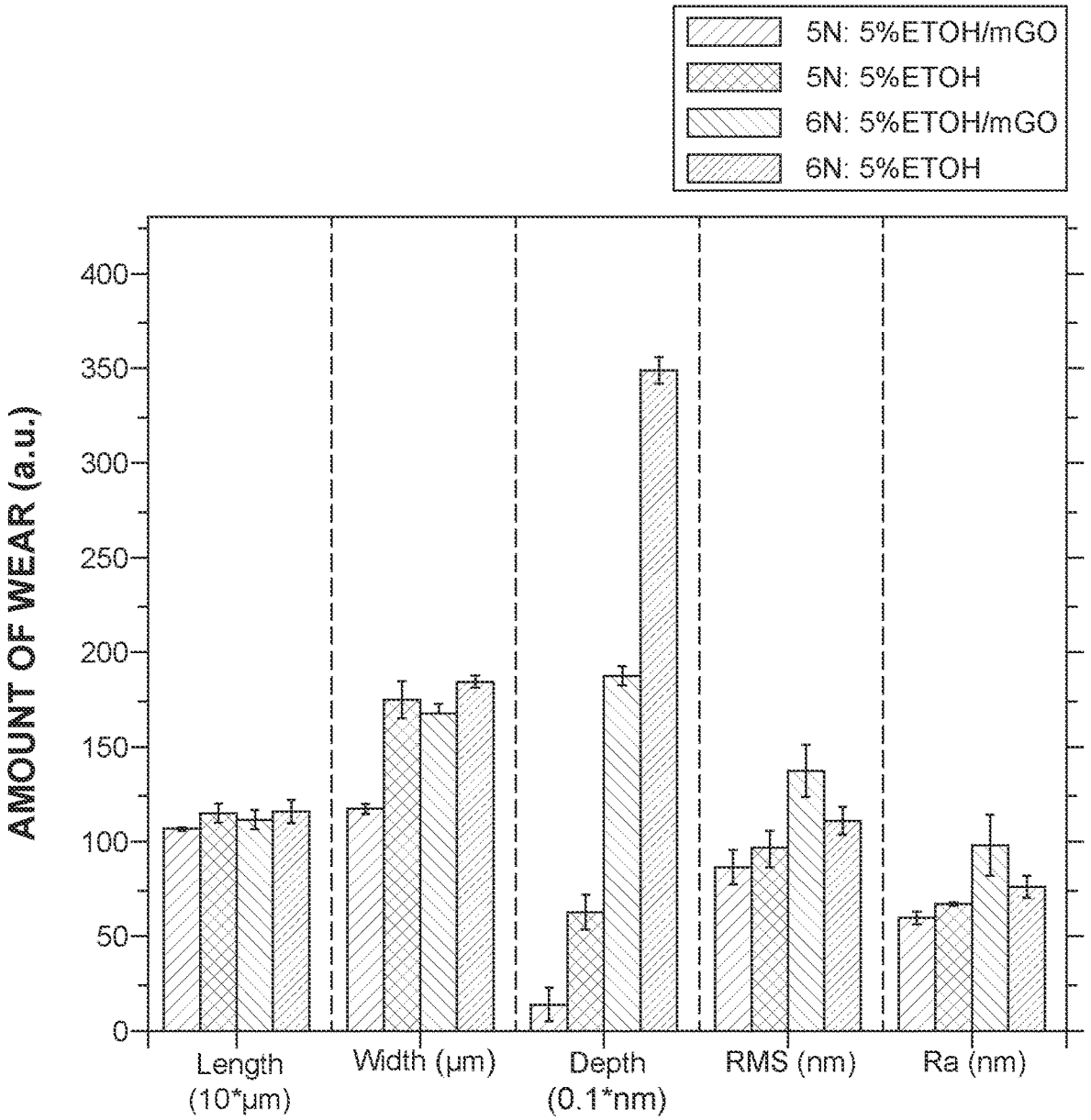
FIG. 8 shows the load effect of various mixtures added to the low sulfur diesel.

The effect of the normal load (exerted by ball 210 in FIG. 2A on the disk 230) due to the fuel lubricity is shown in FIG. 8 for the EtOH only blend and the mGO/EtOH blend, when both blends are 5% of the total LSD fuel. The results shown in FIG. 8 demonstrate that increasing the normal load degrades fuel lubricity of both nanofluid and pure ethanol blends. The applied high normal loads increase asperity-contact induced force, total stress, and wear rate, as shown in equations (1) to (3). The results showed that increasing the contact pressure from 5N to 6N increases the average COFs and the measured surface characteristics, including width, length, depth, Ra, and RMS in both the EtOH and mGO/EtOH blends. Still, the addition of the mGO/EtOH nanofluid can better prevent the sliding ball 210 from penetrating the contacted disk 230 at both 5N and 6N, as compared with the depth differences for the EtOH blend (see FIG. 8).

Figure 9:
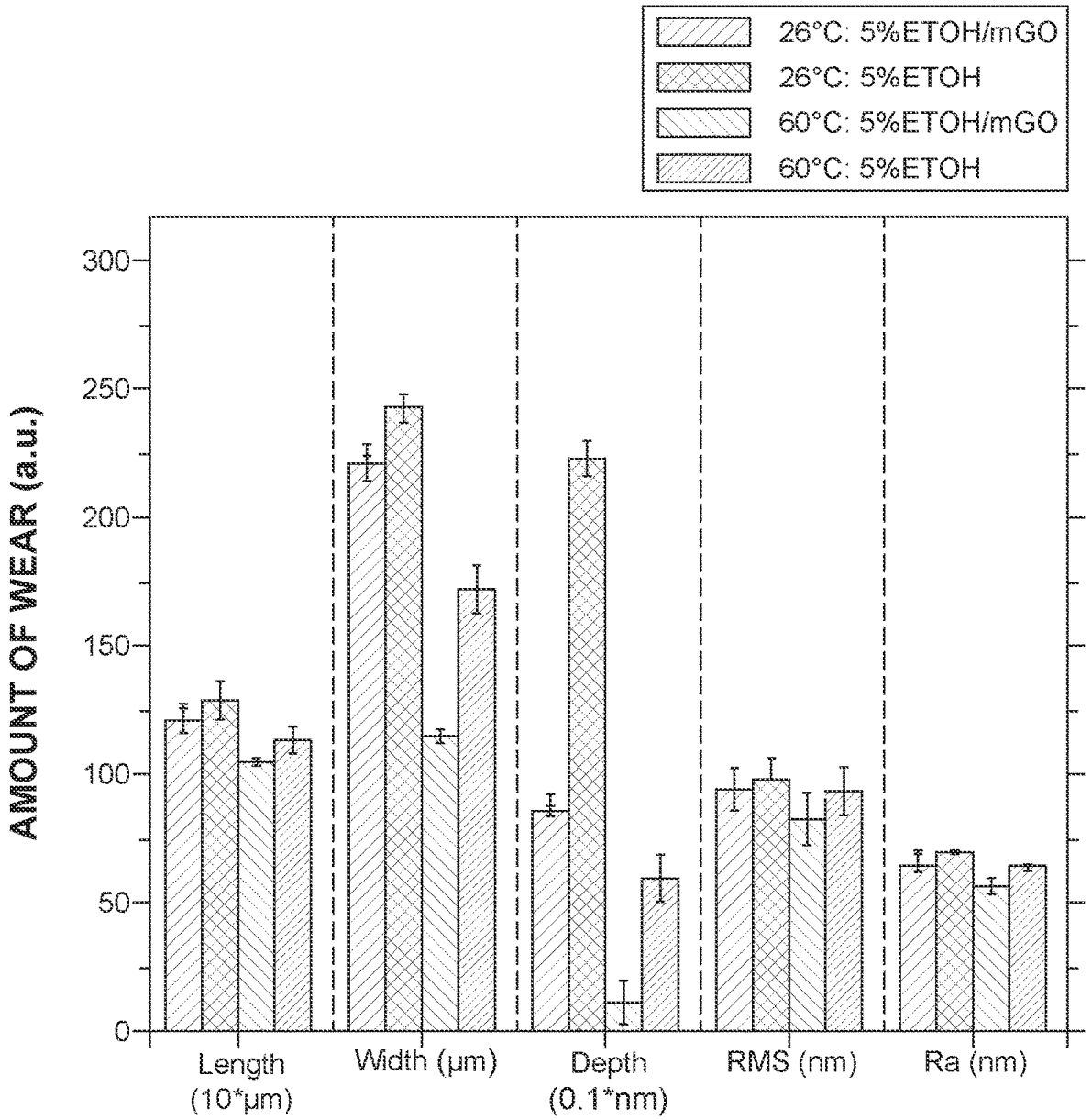
FIG. 9 shows the temperature effect of various mixtures added to the low sulfur diesel.

FIG. 9 illustrates the effect of the ethanol evaporation on the fuel lubricity performance. As the temperature is reduced from 60° C. to 26° C., the evaporation of the ethanol is eliminated during the test. By comparing the measured surface characteristics of the 5% EtOH blend at 26° C. and 60° C., a degradation of fuel lubricity was observed at lower temperature due to the minimization of the ethanol evaporation. A similar conclusion can be drawn for the fuel lubricity of the 5% mGO/EtOH nanofluid tests at 26° C. and 60° C., wherein the fuel lubricity is worse at a lower temperature. Regardless of the effect of ethanol evaporation, the presence of the mGO still minimized the surface wear tracks at 26° C. and 60° C. The result of adding the mGO to ethanol at room temperature confirms the reduction in surface material wear (i.e., rubbed iron substrates) and effectiveness in reducing asperity-contact induced force, as suggested by equation (1).

Figure 10A:
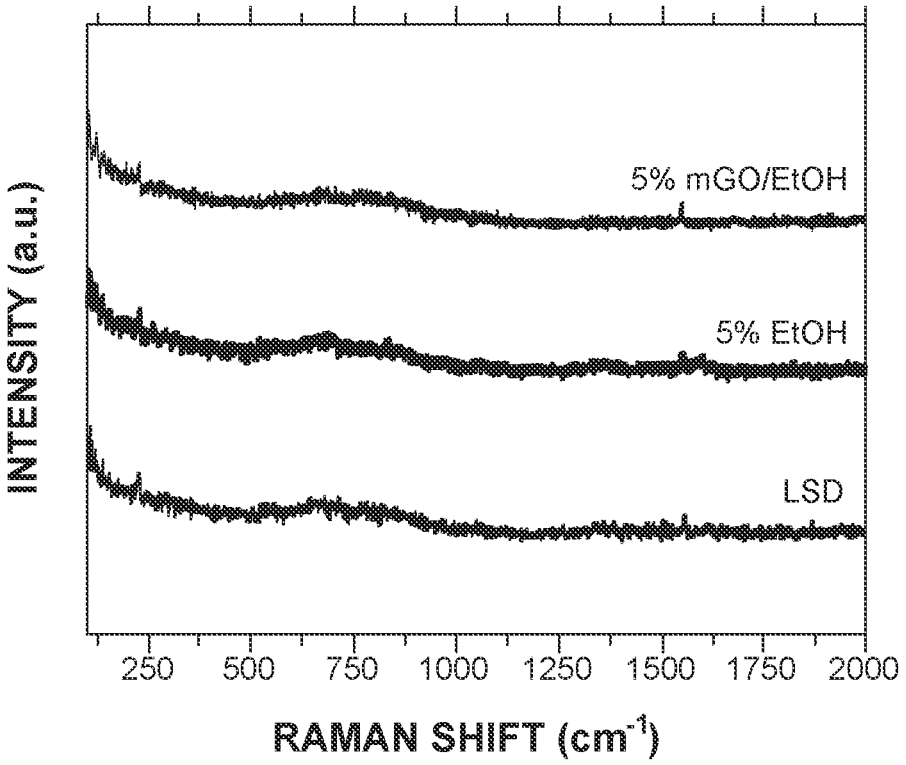
FIGS. 10A to 10C show the Raman spectra for various regions of a test disk.

Studies of the surface morphology are now provided to elucidate the superior fuel lubricity resulting from the nanofluid formulation 150. For this purpose, three different areas from the disk 230 were chosen to be characterized for the wear track corresponding to the 5% mGO/EtOH formulation. These three areas correspond to a bright area, a dark area, and a dark spot with irregular shapes. Similar dark spots could not be found on the wear track of the LSD formulation test or any other tests using ethanol blends. The Raman spectrum, which is illustrated in FIG. 10A, was obtained for the bright area and it shows only small bumps at around 670 $cm^{-1}$, which can be attributed to the presence of magnetite ($Fe_3O_4$). Therefore, the obtained Raman spectrum from the bright area suggests that it represents the polished surface with little damage from sliding the ball 210 against the contacting disk 230.

On the other hand, the Raman spectrum (see FIG. 10B) obtained from the dark area shows various chemical composition profiles, which are not present in the spectrum of the bright area. Intense peaks at 210 $cm^{-1}$, 405 $cm^{-1}$, and 475 $cm^{-1}$ are observed in the spectrum of the dark area in FIG. 10B, corresponding to another type of iron oxide, hematite ($Fe_2O_3$). In addition to hematite, the characteristic peak of magnetite is enhanced with a broadband signal at 670 $cm^{-1}$. The combination of hematite and magnetite are typical products generated from the friction on a stainless steel surface. The broad peaks ranging from 1200 $cm^{-1}$ to 1400 $cm^{-1}$ may be from frictional products of various hydrocarbons, similar to the Raman spectra observed from the graphitic carbon coatings. To generalize, the characteristic peaks of hematite, magnetite, and amorphous carbons obtained from the dark areas are mixtures of frictional products (so-called tribofilm) derived from the tribofilm chemical reactions of the diesel fuel.

Figure 10B:
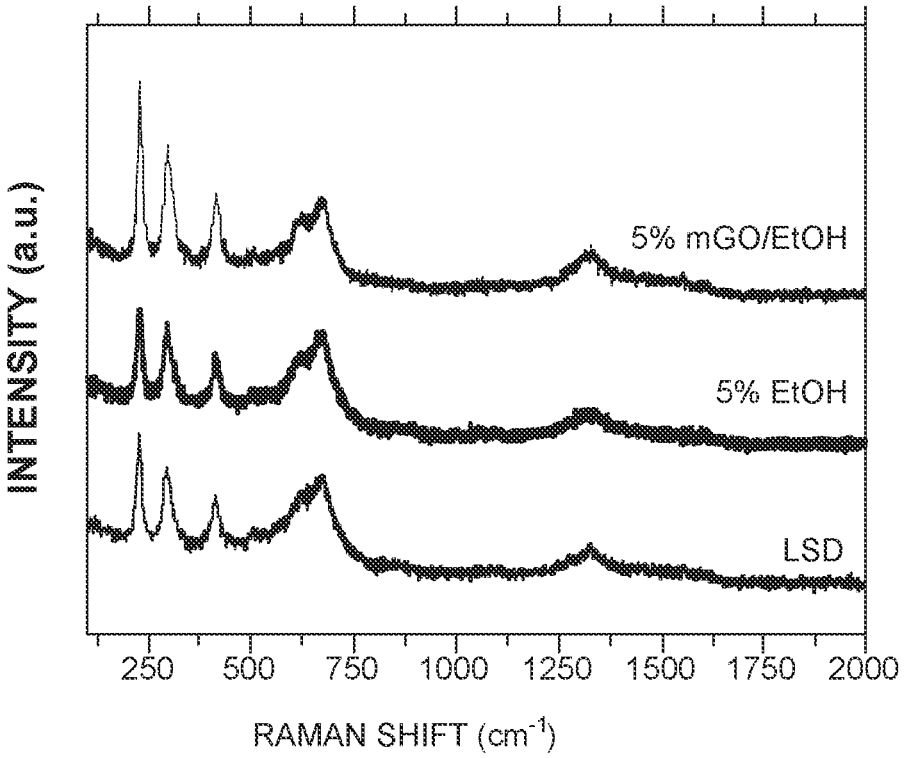

The chemical signatures of the generated tribofilm from various tests performed by the inventors do not vary much in the presence of only the EtOH. Thus, the enhanced fuel lubricity of a 5% mGO/EtOH blend test can be attributed to a number of factors. One of the possible factors that causes the enhanced fuel lubricity by the addition of the nanofluid is the presence of the graphitic film shown in FIG. 10C. The irregular dark spots are the results of graphene oxide-derived tribofilm or graphene-iron oxide flakes, which is justified in FIG. 100 by the existence of the strong peaks at 1350 $cm^{-1}$ (D mode: breathing mode of unorganized graphite) and at 1570 $cm^{-1}$ (G mode: the in-plane stretching motion of sp2 paired carbon). The enhanced D and G bands result from the stress-assisted chemical reactions suggested by equation (3). Additional peaks characterizing the irregular dark spots at 210 $cm^{-1}$, 475 $cm^{-1}$, and 670 $cm^{-1}$ correspond to similar frictional product profile as characterized by the dark areas, which are different types of iron oxides as shown in FIG. 10B. The iron oxides signatures found in the dark spots could be due to the formation of a graphite-iron oxide complex from tribochemical reactions with oxygenated functionalities on graphene oxide.

Furthermore, the worn track corresponding to a 5% mGO/EtOH formulation clearly demonstrates a polished surface covered by a thin layer of organics. Few wear tracks were found in a magnified view from the scale at 200 μm to 200 nm. The obtained surface morphologies from the wear track support the role of the mGO in enhancing the fuel lubricity by polishing the contact surface or eliminating asperity contacts during the ball-on-disk reciprocation action performed with the test system, which is in agreement with previous studies using graphene as dry lubricants.

Figure 10C:
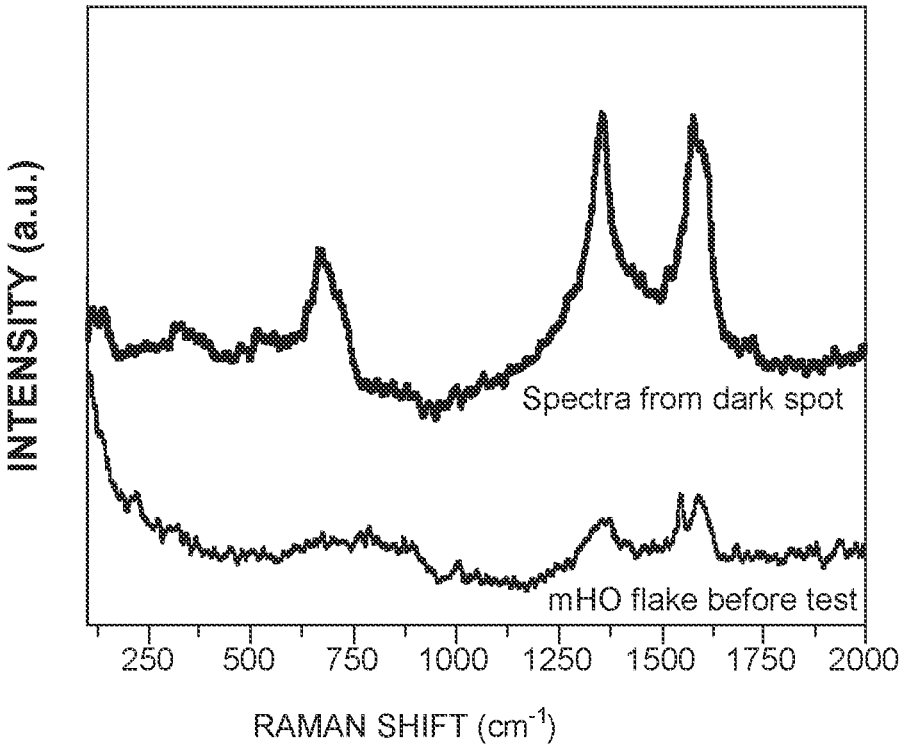

Many studies have shown that blending oxygenated compounds can help LSD regain its fuel lubricity. Typically, the oil film is thin at the boundary lubrication regime where the lubricity of fuels relies on the formation of protective tribofilms to prevent scuffing. The results illustrated in FIGS. 7-9 show that blending EtOH in LSD can be harmful to fuel lubricity, as indicated by the measured surface characteristics of worn disks performed under various experimental conditions. Also, FIGS. 10A to 10C show that only the ethanol cannot aid the formation of amorphous carbon in the LSD derived tribofilm, which leads to fuel lubricity loss. On the other hand, the loss of fuel lubricity from blending the ethanol in the LSD could be rationalized by the understanding of the total horizontal force, total stress and wear rate as described by equations (1) to (3). In FIG. 9, the reduction in the viscosity could lower the shear-induced force. However, an increase in the asperity-contact induced force overrides the benefits brought by the reduction of shear-induced force, which results in the acceleration of wear and loss of fuel lubricity.

As discussed in these embodiments, an effective approach to deal with the asperity-contact induced force and wear is to add a small amount of modified graphene oxide to ethanol. This approach is validated from the results shown in FIGS. 7-9. The increasing amount of mGO prevents the direct contact of the metallic surfaces by either forming a thicker graphitic tribofilm or generating graphene oxide flakes that minimize the contact asperity, as shown in FIG. 10B. In principle, applying a greater normal load (such as at high fuel injection pressures) increases the asperity-contact induced force, total horizontal force, and total stress, which accelerates the wear on the contacting surface. The results in FIG. 8 show that the addition of the mGO can effectively reduce asperity-contact induced force, stress and wear even at higher fuel injection pressures. The introduction of a carbon-based nanofluid to the fuel delivery system may provide a new strategy to enhance the fuel lubricity by forming protective graphitic surfaces without the concern of generating corrosive deposits on fuel injectors, which are commonly found in biodiesel blended diesel.

Also, dodecanol modified graphene oxide eliminates concerns of the unstable dispersion of nanomaterials in non-polar hydrocarbon solutions. The method for modifying the carbon-based nanomaterials described in these embodiments can enable the use of carbon-based nanofluid to enhance dispersion stability, and more importantly, free from the use of surfactants or detergents. Surfactants are typically ionic compounds that are corrosive to metallic components of the fuel delivery system, and the use of calcium or magnesium ion containing detergents, similar to the engine oil detergent formula, can initiate abnormal combustion events in internal combustion engines. Using mGO can therefore mitigate these aforementioned issues.

One or more of the embodiments discussed herein demonstrate how the modified graphene oxide can effectively alter the original behavior of ethanol on fuel lubricity of LSD under various conditions. Results presented in this application indicate the effective role of the modified graphene oxide in enhancing LSD fuel lubricity. The tribological results from different temperatures, loads, and concentrations in this application suggest that: (1) ethanol per se has no promoting effect on LSD fuel lubricity, (2) the asperity-contact induced force may outweigh the benefits of shear-induced force when formulating LSD with low-viscosity biofuels, such as ethanol, propanol, or butanol, (3) the modified graphene oxide mixed with the EtOH enhanced diesel fuel lubricity by effectively eliminating asperity-contact induced friction and/or generating a protective graphite-like tribofilm, and (4) the carbon-based nanofluids can help maintain fuel lubricity at higher fuel injection pressures.

Figure 11:
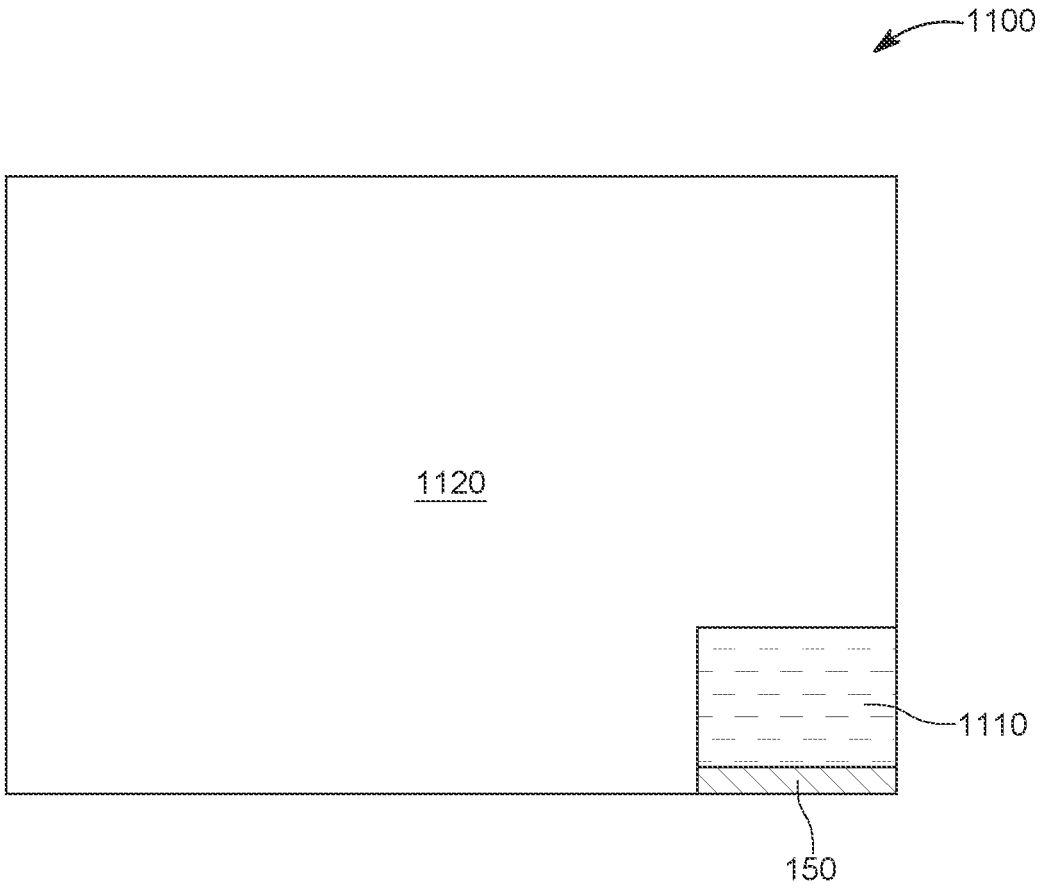
FIG. 11 schematically illustrates a chemical composition of a fuel mixture that includes the modified graphene oxide nanoparticles.

Based on the observations noted above, the inventors have found that by adding a mixture of mGO and EtOH to any fuel (e.g., LSD), it is possible to improve not only its lubricity, but also its burning rate. Thus, in this embodiment, a composition of matter or a fuel mixture 1100, which is schematically illustrated in FIG. 11, includes mGO 150 mixed with EtOH 1110, so that the mGO represents 40 to 1000 ppm (50 ppm in one application) of the mixture. This mixture of mGO 150 and EtOH 1110 is blended with a fuel 1120, in a range from 1% to 10%. In one embodiment, the mixture of mGO 150 and EtOH 1110 is 5% of the total composition 1100. The fuel 1120 may be any fuel that is burned into a combustion engine or power plant. In this embodiment, the fuel is LSD. However, the fuel may also be biofuel or jet fuel. The EtOH may be replaced with methyl esters or butanol. The particles of mGO are in the nanorange.

Figure 12:
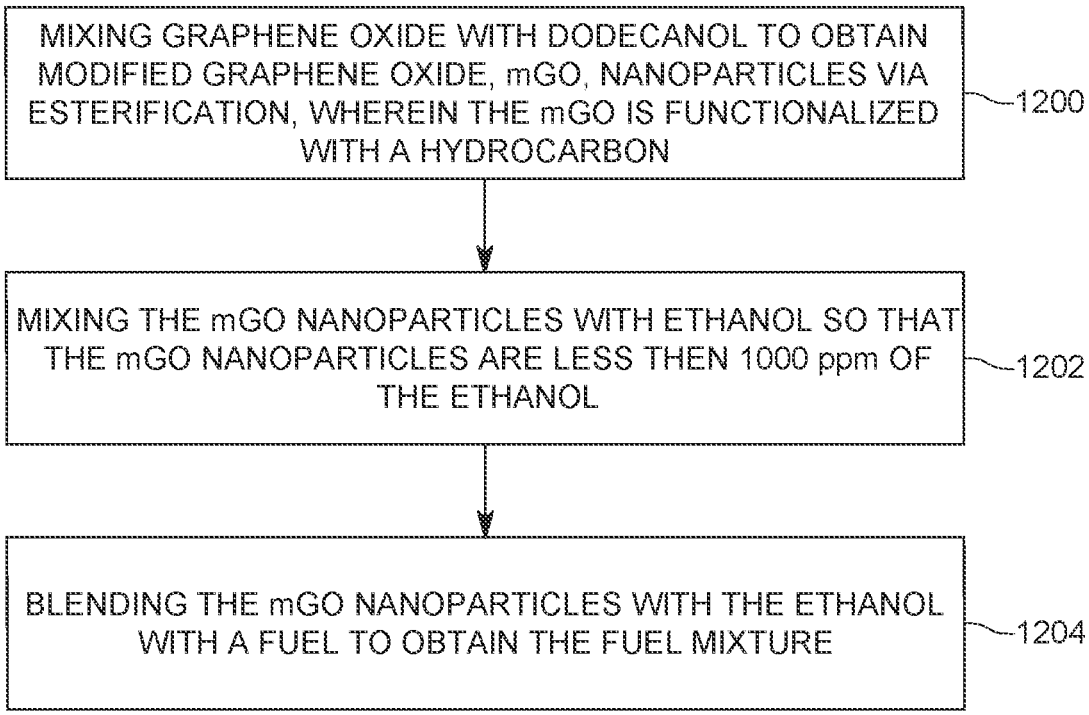
FIG. 12 is a flow chart of a method for making the fuel mixture that includes the modified graphene oxide nanoparticles.

A method for making the fuel mixture discussed above is now discussed with regard to FIG. 12. The method includes a step 1200 of mixing graphene oxide 110 with dodecanol 120 to obtain the mGO nanoparticles 150 via esterification, where the mGO is functionalized with a hydrocarbon, a step 1202 of mixing the mGO nanoparticles with ethanol so that the mGO nanoparticles are less than 1000 ppm of the ethanol, and a step 1204 of blending the mGO nanoparticles 150 with the ethanol with a fuel 1120 to obtain the fuel mixture 1100, where the ethanol and the mGO nanoparticles are less than 10% of the fuel mixture.

In one application, the mGO nanoparticles are equal to or less than 50 ppm of the ethanol. In the same application or another one, a mixture of the ethanol and the mGO nanoparticles is equal to or less than 5% of the fuel mixture. The fuel may be low sulfur diesel. In one application, the hydrocarbon includes 12 atoms of C, and 24 atoms of H or 26 atoms of H. The esterification process is catalyzed by p-toluene sulfonic acid monohydrate. The graphene oxide is placed dimethylformamide prior to the esterification process. In one application, the graphene oxide is single-layer.

The disclosed embodiments provide a new composition of matter that includes modified graphene oxide nanoparticles functionalized with hydrocarbons. It should be understood that this description is not intended to limit the invention. On the contrary, the embodiments are intended to cover alternatives, modifications and equivalents, which are included in the spirit and scope of the invention as defined by the appended claims. Further, in the detailed description of the embodiments, numerous specific details are set forth in order to provide a comprehensive understanding of the claimed invention. However, one skilled in the art would understand that various embodiments may be practiced without such specific details.

Although the features and elements of the present embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

REFERENCES

[1] Berman D, Erdemir A, Sumant A V. Graphene: a new emerging lubricant. Mater Today 2014; 17:31-42. doi: 10.1016/j.mattod.2013.12.003.

[2] Gupta B, Kumar N, Panda K, Dash S, Tyagi A K. Energy efficient reduced graphene oxide additives: Mechanism of effective lubrication and antiwear properties. Sci Rep 2016; 6:18372. doi:10.1038/srep18372.

[3] Zhai W, Srikanth N, Kong L B, Zhou K. Carbon nanomaterials in tribology. Carbon N Y 2017; 119:150-71. doi:10.1016/J.CARBON.2017.04.027.

[4] Choi, S. U. S.; Eastman J A. Enhancing thermal conductivity of fluids with nanoparticles. ASME, 1995, p. 99-106.

[5] Hulwan D B, Joshi S V. Performance, emission and combustion characteristic of a multicylinder DI diesel engine running on diesel-ethanol-biodiesel blends of high ethanol content. Appl Energy 2011; 88:5042-55. doi: 10.1016/j.apenergy.2011.07.008.

[6] Chen H, Shuai S J, Wang J X. Study on combustion characteristics and PM emission of diesel engines using ester-ethanol-diesel blended fuels. Proc Combust Inst 2007; 31 II:2981-9. doi:10.1016/j.proci.2006.07.130.

[7] Rakopoulos D C, Rakopoulos C D, Giakoumis E G, Papagiannakis R G, Kyritsis D C. Influence of properties of various common bio-fuels on the combustion and emission characteristics of high-speed DI (direct injection) diesel engine: Vegetable oil, bio-diesel, ethanol, n-butanol, diethyl ether. Energy 2014; 73:354-66. doi:10.1016/j.energy.2014.06.032.

[8] E L-Seesy Al, Hassan H. Investigation of the effect of adding graphene oxide, graphene nanoplatelet, and multiwalled carbon nanotube additives with n-butanol-Jatropha methyl ester on a diesel engine performance. Renew Energy 2019; 132:558-74. doi:10.1016/J.RENENE.2018.08.026.

[9] Soudagar M E M, Nik-Ghazali N-N, Kalam M A, Badruddin I A, Banapurmath N R, Yunus Khan T M, et al. The effects of graphene oxide nanoparticle additive stably dispersed in dairy scum oil biodiesel-diesel fuel blend on CI engine: performance, emission and combustion characteristics. Fuel 2019; 257:116015. doi:10.1016/J.FUEL.2019.116015.

[10] Ghamari M, Ratner A. Combustion characteristics of colloidal droplets of jet fuel and carbon based nanoparticles. Fuel 2017; 188:182-9. doi:10.1016/j.fue1.2016.10.040.

[11] U.S. Pat. No. 5,779,742.

[12] ES2236255T3.

[13] Japanese Patent Application JP2005508442A.

[14] U.S. Patent Application Publication no. 2009/0000186.

[15] U.S. Pat. No. 8,741,821 B2.

[16] International Patent Application WO 2018/224902.

What is claimed is:

1. A fuel mixture comprising:

a fuel;

ethanol; and modified graphene oxide (mGO) nanoparticles functionalized with a hydrocarbon, wherein the mGO is less than 1000 ppm of the ethanol, and wherein a blend of the ethanol and the mGO is less than 10% of the fuel mixture.

2. The fuel mixture of claim 1, wherein the mGO is equal to or less than 50 ppm of the ethanol.

3. The fuel mixture of claim 2, wherein the blend of the ethanol and the mGO is equal to or less than 5% of the fuel mixture.

4. The fuel mixture of claim 3, wherein the fuel is low sulfur diesel.

5. The fuel mixture of claim 1, wherein the hydrocarbon includes only 12 atoms of C.

6. The fuel mixture of claim 5, wherein the hydrocarbon includes only 24 atoms of H.

7. The fuel mixture of claim 5, wherein the hydrocarbon includes only 26 atoms of H.

8. A method of making a fuel mixture, the method comprising:

mixing graphene oxide with dodecanol to obtain modified graphene oxide, mGO, nanoparticles via esterification, wherein the mGO is functionalized with a hydrocarbon;

mixing the mGO nanoparticles with ethanol so that the mGO nanoparticles are less than 1000 ppm of the ethanol; and blending the mGO nanoparticles with the ethanol with a fuel to obtain the fuel mixture, wherein the ethanol and the mGO nanoparticles are less than 10% of the fuel mixture.

9. The method of claim 8, wherein the mGO nanoparticles are equal to or less than 50 ppm of the ethanol.

10. The method of claim 9, wherein a mixture of the ethanol and the mGO nanoparticles is equal to or less than 5% of the fuel mixture.

11. The method of claim 10, wherein the fuel is low sulfur diesel.

12. The method of claim 8, wherein the hydrocarbon includes only 12 atoms of C.

13. The method of claim 12, wherein the hydrocarbon includes only 24 atoms of H.

14. The method of claim 12, wherein the hydrocarbon includes only 26 atoms of H.

15. The method of claim 8, wherein the esterification process is catalyzed by p-toluene sulfonic acid monohydrate.

16. The method of claim 15, wherein the graphene oxide is placed in dimethylformamide prior to the esterification process.

17. The method of claim 15, wherein the graphene oxide is single-layer.

18. A method of making a fuel mixture, the method comprising:

mixing a single-layer graphene oxide with a reacting agent to obtain modified graphene oxide, mGO, nanoparticles via esterification, wherein the mGO is functionalized with a hydrocarbon;

mixing the mGO nanoparticles with ethanol so that the mGO nanoparticles are less than 1000 ppm of the ethanol; and blending the mGO nanoparticles with the ethanol with a fuel to obtain the fuel mixture, wherein the ethanol and the mGO nanoparticles are less than 10% of the fuel mixture, and wherein the reacting agent is X-(0)R1, where X is one of H, OH, S, or N, and R1 is a linear or branched hydrocarbyl group.

19. The method of claim 18, wherein the mGO nanoparticles are equal to or less than 50 ppm of the ethanol.

20. The method of claim 19, wherein a mixture of the ethanol and the mGO nanoparticles is equal to or less than 5% of the fuel mixture.

* * * * *